United States Patent [19]

Wright

[11] Patent Number: 4,753,207

[45] Date of Patent: Jun. 28, 1988

[54] LOW VOLTAGE SUPPLY CONTROL SYSTEM FOR FUEL INJECTORS

[75] Inventor: Danny O. Wright, Grafton, Va.

[73] Assignee: Allied Corporation, Morris Township, Morris County, N.J.

[21] Appl. No.: 925,571

[22] Filed: Oct. 30, 1986

[51] Int. Cl.[4] ..... F02M 51/00

[52] U.S. Cl. ..... 123/490; 361/154

[58] Field of Search ..... 123/490; 251/129.15; 361/154

[56] References Cited

U.S. PATENT DOCUMENTS

| | | | |
|---|---|---|---|
| 3,613,644 | 10/1971 | Porsche et al. | 123/490 |
| 4,040,397 | 8/1977 | Leichle | 123/490 |
| 4,140,084 | 2/1979 | Di Nunzio | 123/490 |
| 4,161,306 | 7/1979 | Brune et al. | 251/129.15 |
| 4,576,135 | 3/1986 | Johnson | 123/490 |
| 4,607,311 | 8/1986 | Brown et al. | 123/490 X |

*Primary Examiner*—Willis R. Wolfe, Jr.

*Attorney, Agent, or Firm*—Russel C. Wells; Markell Seitzman

[57] ABSTRACT

A low voltage supply control system provides on command a voltage doubling of the supply voltage to the fuel injector coils of a fuel injection system. The command signal is responsive to the magnitude of the battery voltage falling below a predetermined level at any time during the operation of the fuel injection systems be it on cold starting or during a component failure in the power generating system of the vehicle during operation. The advantage of this system is that the impedance of the fuel injector coils is typically many times higher than that of coils used without the low voltage supply control system. Overall the cost advantages of the low voltage supply control system are very attractive.

3 Claims, 1 Drawing Sheet

LOW VOLTAGE SUPPLY CONTROL SYSTEM FOR FUEL INJECTORS

FIELD OF INVENTION

This invention generally relates to electrical circuits for use in electronic fuel injection systems and more particularly electronic systems for controlling low voltage energizing of fuel injectors.

BACKGROUND OF THE INVENTION

Cold starting of fuel injected gasoline engines has always caused the designers of fuel injection systems much concern. The main reason for the concern is that during the cold starting sequence, the battery voltage is often low and therefor the power necessary to turn on the injectors may not be available. With this in mind, many sophisticated and complex driver circuits have been developed.

In order to solve this problem, many fuel injection systems have used an extra fuel injector placed upstream of the intake manifold to inject extra fuel for a predetermined period of time. Other solutions have been to add a correction length to each fuel injection pulse as it is calculated. This extends a normally longer pulse to an even greater length and may, under certain circumstances, cause pulse overlap. Still other solutions have included the addition of fuel pulses during the time that the engine is cold. See U.S. Pat. No. 4,096,831 issued on June 27, 1978 to R. Gunda and entitled "Frequency Modulated Fuel Injection System". Other solutions use a low impedance injector coil and special peak and hold current driver circuits. In those applications wherein the injectors are energized in sequence and not as a group, this requires one such special circuit for each injector position.

It is a principal advantage of the present invention to selectively control the voltage applied to the fuel injector driver circuit during low voltage conditions. It is a further advantage of the present invention to effectuate significant cost savings by a reduction in the number of components needed to control the operation of the fuel injectors and fuel injector driver circuits. It is still a further advantage of the this system to simplify the injector driver circuit to a basic switch circuit and remove the requirement of complex peak and hold current circuits. It is yet another advantage of this system to utilize high impedance injector coils thereby reducing the electrical power consumption of the overall fuel injection system.

SUMMARY OF INVENTION

A low voltage supply control system for fuel injectors in a fuel injection system having a source of power and at least one electromagnetic fuel injector. An electronic control unit or other means calculates the operating time of the at least one electromagnetic fuel injector to supply the proper amount of fuel to the engine. For calculating the operating time the means is responsive to the magnitude of the source of power for generating a pulse-width operating signal which is supplied to injector driver means responsive to energize the electromagnetic fuel injector. Other means compares the magnitude of the source of power with a predetermined magnitude value and generates a control signal when the magnitude of the source of power is less than the predetermined magnitude value and supplies this control signal to a voltage supply means which in response to the control signal substantially doubles the magnitude of the source of power to the injector driver means.

Many other objects and purposes of the invention will be clear from the following detailed description of the drawings.

BRIEF DESCRIPTION OF THE DRAWINGS

The sole FIGURE is a schematic of the electronic circuit of the present invention.

DETAILED DESCRIPTION OF THE PREFERRED EMBODIMENT

Figure 1:
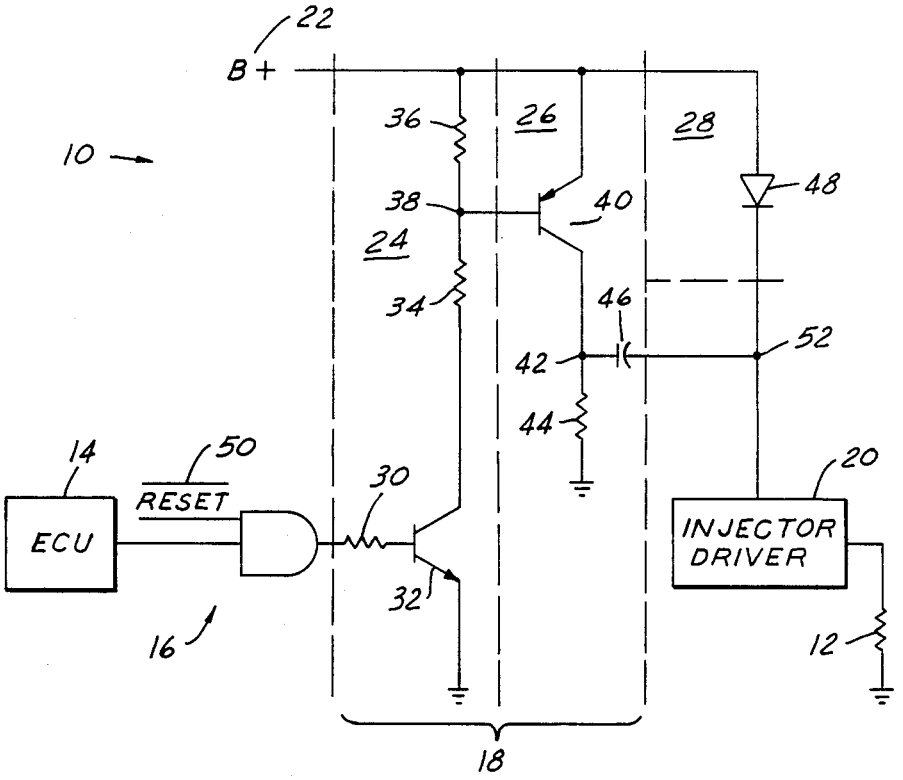

In the FIGURE, there is illustrated in schematic form the low voltage supply control system 10 for fuel injectors 12 as may be found in fuel injection systems for motor vehicles. In particular, the system may be used with gasoline spark ignited internal combustion engines.

The total system includes an electronic control unit 14, control logic 16, the voltage supply control circuit 18, and the injector driver control 20. The electronic control unit or ECU 14 is the heart of the fuel injection systems and may include a microprocessor based control unit which functions in response to various input engine operating conditions to calculate the time and amount of fuel injection. Such input engine operating conditions are the coolant or engine temperature, the engine speed, the voltage supply levels and many other engine operating conditions.

The control logic 16 for the present embodiment may be as simple as a direct connection from the ECU 14 to the voltage supply control circuit 18 to a plurality of logic gates to effectuate more complete control over the utilization of the voltage supply control circuit. The injector driver control circuit 20 may be a circuit for continuous operation of fuel injector 12, a circuit for a single point fuel injection system having as few as a single injector or any of the various styles of multipoint fuel injection systems where one or more injectors supply fuel to a given cylinder of the engine. One such injector driver circuit is the subject of U.S. Pat. No. 4,238,813 issued on Dec. 9, 1980 to Carp and Wright and entitled "Compensated Dual Injector Driver" and is assigned to a common assignee. This patent is incorporated herein by reference.

In the present system, the injector drive control circuit 20 may be as simple as a basic electronic switch for connecting the battery voltage 22 to the injector 12 when it is to be operated. However, other drive control circuits may also be used.

The injector coils of the injectors 12 as used in the present system are high impedance coils. In the preferred embodiment, the coils are wound with brass wire instead of copper wire and the result is the maintenance of the same number of amphere turns with a higher impedance coil. Typical impedance values for copper wire coils are two to three ohms and for brass wire coils are in the fifteen ohm range.

The voltage supply control circuit 18 as illustrated in the FIGURE has an input transistor stage, a power transistor stage 24, and coupling diode stage 28. The input transistor stage 24 has an input resistor 30 connected to the base lead of a transistor 32. The transistor 32 in the preferred embodiment is a NPN transistor which is connected in a grounded emitter configuration with a pair of series connected resistors 34, 36 connecting the collector to the source of voltage 22.

At the junction 38 of the pair of resistors, which together form a voltage divider, the base lead of a power transistor 40 in the power transmitter stage is connected. The emitter of the power transistor 40, which is a PNP transistor, is connected to the to the source of voltage 22 and the collector is connected to the junction 42 of a collector resistor 44 having its other end connected to ground and to a storage capacitor 46.

The other end of the storage capacitor 46 is connected to the coupling diode stage 28. The coupling diode stage as illustrated has the anode of a diode 48 connected to the source of voltage 22 and the cathode connected to the storage capacitor 46 and the input line of the injector driver control circuit 20. The coupling diode stage 28 operates to supply the voltage and power required to the injector driver control circuit 20 in order to operate the injectors 12 which are connected to the output leads of the circuit. Once the injectors 12 are operated, the power to the coils may be reduced and therefore the voltage supply control circuit 18 is adapted to be turned off and the power to the injectors 12 is supplied only through the coupling diode 28.

In the preferred embodiment, the coupling diode 48 is a Schottky diode in order to reduce the power dissipation in the diode. The Schottky diode has a low forward voltage drop, on the order of two or three tenths of a volt and therefor the power dissipation of the diode 48 is reduced. If electric power dissipation of the overall electronic fuel injection system is not a concern, a conventional diode may be used.

The storage capacitor 46 is a large capacitor to handle the amount of charge necessary for the operation of the voltage supply control circuit 18. The circuit configuration is not the conventional voltage doubler circuit wherein there is a charge transfer between a pair of capacitors. The charge developed on the storage capacitor 46 is sufficient to provide enough power to energize the injector coils. The effect of turning on the power transistor stage 4 is to transfer the voltage from the collector of the power transistor 40 and add it to the voltage at the cathode of the coupling diode 48. This will back bias the coupling diode 48 and the power for the injector coils is supplied from the storage capacitor 46 until the coupling diode 48 becomes forward biased. At that time the power transistor 40 is turned off and the storage capacitor 46 is recharged through the diode and collector resistor 44 of the power transistor 40.

OPERATION

It is the fundamental purpose of the low voltage supply control system for fuel injectors, to provide sufficient voltage levels to the injector driver control circuit 20 so that the effect of low voltage and/or low engine speed is minimal. In addition the low voltage supply control system may be an intelligent system in that the system may be controlled to operate any time that the magnitude of the source of voltage is below a predetermined level.

The ECU 14 in response to various input conditions, calculates a fuel pulse width necessary to operate the engine. In doing so, the level of the battery voltage 22 is determined and the pulse width is calculated accordingly. If the battery voltage 22 is less than a predetermined level, a control signal 50 is generated to initiate the low voltage supply control system 10. This control signal also causes the ECU 14 to calculate with a voltage level which is significantly higher than the battery voltage 22. Typically, the new level is approximately twice the sensed level when the control signal 50 is generated.

This control signal 50 is applied to the base of the input transistor 32 causing the power transistor 40 to turn on and the storage capacitor 46 to discharge. The discharge of the storage capacitor 46 causes the voltage at the junction 52 of the storage capacitor 46 and the coupling diode 48 to be increased by substantially the value of the battery supply 22 less the small voltage drops across the power transistor 40.

The control signal 50 is a timed pulse signal starting at the beginning of the pulse width signal from the ECU 14 for turning on the input transistor 32 after a predetermined period of time, turning the power transistor 40 off. This time is on the order of four time constants of the injector coil. The diode 48 and collector resistor 44 supplies current to the storage capacitor 46 for recharging the capacitor 46 to the source of voltage 22.

The following chart illustrates an example of the comparative opening times of a high impedance injector using the low voltage supply control system, 'System', as described herein:

| Battery Voltage (volts) | Opening time of the Injector 'Normal' (milliseconds) | 'System' (milliseconds) |
|---|---|---|
| 5.0 | 7.8* | 2.5 |
| 5.5 | 5.3 | 2.1 |
| 6.0 | 4.3 | 1.8 |
| 6.5 | 3.5 | 1.6 |
| 7.0 | 3.2 | 1.45 |
| 7.5 | 2.85 | 1.35 |
| 8.0 | 2.55 | 1.25 |
| 8.5 | 2.4 | 1.2 |
| 9.0 | 2.2 | 1.1 |

*This time was unstable

This test was run at a simulated engine speed of 250 RPM. The control signal pulse length was 2.0 milliseconds.

There has thus been described a low voltage supply control system 10 for fuel injectors 12 which allows the use of high impedance fuel injector coils and simplified injector driver circuits 20. Such a control system 10 is useful in sequential multipoint fuel injection systems for multicylinder engines where each injector 12 is individually controlled. In such a system, the control signal 50 is generated each time that an injector is to be energized and the battery voltage is low. This may be at engine start or at any time during the operation of the engine when the battery voltage is low.

Many changes and modifications in the above described embodiment of the invention can, of course, be carried out without departing from the scope thereof. Accordingly, that scope is intended to be limited only by the scope of the appended claims.

I claim:

1. A low voltage supply control system for fuel injectors in a fuel injection system, the system comprising:

a source of power;

at least one electromagnetic fuel injector;

means for calculating the operating time of said at least one electromagnetic fuel injector, said means responsive to the magnitude of said source of power for generating a pulse-width operating signal;

injector driver means responsive to the pulse-width operating signal for energizing said at least one electromagnetic fuel injector;

means for comparing the magnitude of said source of power with a predetermined magnitude value and generating a control signal when the magnitude of said source of power is less than said predetermined magnitude value; and voltage supply means responsive to said control signal for substantially doubling the magnitude of said source of power to said injector driver means, said voltage supply means comprises an input logic stage, a power stage, a storage capacitor and a coupling diode for connecting said injector driver means to said source of power.

2. A low voltage supply control system for fuel injectors in a fuel injection system, according to claim 1 wherein said power stage operates to charge said storage capacitor to said source of power and in response to said control signal operates to substantially double the magnitude of said source of power to said injector drive means.

3. A low voltage supply control system for fuel injectors in a fuel injection system, according to claim 1 wherein said coupling diode is a low forward voltage drop device.

* * * * *